US008912720B2

(12) United States Patent
Fransson et al.

(10) Patent No.: US 8,912,720 B2
(45) Date of Patent: Dec. 16, 2014

(54) METAL HALIDE LAMP WITH DOUBLE ARC TUBES

(75) Inventors: Martin Fransson, Hallabro (SE); Mikael Severinsson, Rodeby (SE)

(73) Assignee: Auralight International AB (SE)

( * ) Notice: Subject to any disclaimer, the term of this patent is extended or adjusted under 35 U.S.C. 154(b) by 199 days.

(21) Appl. No.: 13/505,960

(22) PCT Filed: Sep. 23, 2010

(86) PCT No.: PCT/SE2010/051025

§ 371 (c)(1),
(2), (4) Date: Jul. 19, 2012

(87) PCT Pub. No.: WO2011/056120

PCT Pub. Date: May 12, 2011

(65) Prior Publication Data

US 2012/0280615 A1 Nov. 8, 2012

(30) Foreign Application Priority Data

Nov. 5, 2009 (SE) ..... 0950829

(51) Int. Cl.

| | |
|---|---|
| ***H01J 17/16*** | (2012.01) |
| ***H01J 61/30*** | (2006.01) |
| ***H01J 61/82*** | (2006.01) |
| ***H01J 61/34*** | (2006.01) |
| ***H01J 61/92*** | (2006.01) |

(52) U.S. Cl.

CPC ..... *H01J 61/92* (2013.01); *H01J 61/827* (2013.01); *H01J 61/34* (2013.01)

USPC ..... 313/634; 313/493; 313/636

(58) Field of Classification Search

CPC ..... H01J 61/125; H01J 61/827; H01J 61/34; H01K 3/20; H01K 1/18; H01K 1/02; H01K 1/40

USPC ..... 313/634, 317, 579, 493, 636

See application file for complete search history.

(56) References Cited

U.S. PATENT DOCUMENTS

| | | | |
|---|---|---|---|
| 4,029,983 | A | 6/1977 | Thornton |
| 4,287,454 | A | 9/1981 | Feurersanger et al. |

(Continued)

FOREIGN PATENT DOCUMENTS

| | | | |
|---|---|---|---|
| CN | 1833305 | A | 9/2006 |
| CN | 201084700 | Y | 7/2008 |

(Continued)

OTHER PUBLICATIONS

"International Application Serial No. PCT/SE2010/051025, International Preliminary Report on Patentability dated Oct. 4, 2011", 8 pgs.

(Continued)

*Primary Examiner* — Anh Mai
*Assistant Examiner* — Kevin Quarterman
(74) *Attorney, Agent, or Firm* — Schwegman Lundberg & Woessner, P.A.

(57) ABSTRACT

The present invention relates to a metal halogen lamp comprising, inside an outer casing (7), first (3) and second (5) arc tube members, which are electrically parallel-connected and are connected via conductive members (9) to a base part (11), each arc tube member having a first end (15), facing toward the top part (17) of the outer casing (7) opposite the base part (11), and a second end (19), facing toward the base part (11). The first arc tube member (3) is arranged closer to the top part (17) than the second arc tube member (5), and the second end (19) of the first arc tube member (3) and the first end (15) of the second arc tube member (5) adjoin an imaginary plane (P) defined substantially transversely to the center line (CL) of the outer casing (7), which center line extends from the top part (17) to the base part (11).

12 Claims, 2 Drawing Sheets

(56) References Cited

U.S. PATENT DOCUMENTS

| | | | | |
|---|---|---|---|---|
| 4,724,361 | A | 2/1988 | Wada et al. | |
| 4,958,103 | A | 9/1990 | Jacobs et al. | |
| 6,111,359 | A | 8/2000 | Work et al. | |
| 6,127,772 | A | 10/2000 | Carlson | |
| 2005/0093454 | A1* | 5/2005 | Fridrich | 313/634 |
| 2005/0156501 | A1* | 7/2005 | Kasak et al. | 313/343 |
| 2009/0015162 | A1* | 1/2009 | Bernard et al. | 313/625 |

FOREIGN PATENT DOCUMENTS

| | | | | |
|---|---|---|---|---|
| CN | 201182029 | Y | | 1/2009 |
| EP | 0477914 | A2 | | 4/1992 |
| EP | 1650785 | A1 | | 4/2006 |
| EP | 1650785 | B1 | | 1/2010 |
| JP | S54132375 | A | | 10/1979 |
| JP | 2006-100089 | A | | 4/2006 |
| JP | 2006100089 | A | * | 4/2006 |
| WO | WO-9109415 | A1 | | 6/1991 |
| WO | WO-2008/143587 | A1 | | 11/2008 |
| WO | WO-2009/006828 | A1 | | 1/2009 |
| WO | WO-2011/056120 | A1 | | 5/2011 |

OTHER PUBLICATIONS

"International Application Serial No. PCT/SE2010/051025, International Search Report mailed Mar. 2, 2011", 4 pgs.
"Chinese Application Serial No. 201080050158.X, Office Action mailed Apr. 16, 2014", (English Translation), 11 pgs.
"International Application Serial No. PCT/SE2010/051025, Written Opinion mailed Mar. 2, 2011", 6 pgs.

* cited by examiner

METAL HALIDE LAMP WITH DOUBLE ARC TUBES

RELATED APPLICATIONS

This application is a nationalization under 35 U.S.C. §371 from International Application Serial No. PCT/SE2010/051,025, filed Sep. 23, 2010 and published as WO 2011/056120 A1 on May 12, 2011, which claims the priority benefit of Sweden Application Serial No. 0950829-2, filed Nov. 5, 2009, the contents of which applications and publication are incorporated herein by reference in their entirety.

TECHNICAL FIELD

The present invention relates to a metal halogen lamp as claimed in the preamble to patent claim 1.

The invention concerns the manufacturing industry for ceramic metal halogen lamps, which are designed to be able to deliver the greatest possible light quantity for as long a time as possible, at the same time as being space-saving.

BACKGROUND ART

The working principle of a traditional metal halogen lamp is that an arc is created between two electrodes enclosed in a burner glass tube (so-called arc tube or burner). The arc is generated by a mixture of suitable gases for emitting light. The burner glass tube is configured as compactly as possible, accommodating as large a part of said gases as possible for consumption during operation. The burner glass tube is produced in elongated form with an electrode at each end, wherein the length of the burner glass tube is often approximately twice as large as the width of the burner glass tube. The burner glass tube is expediently placed inside a closed space formed by a transparent glass body. In traditional metal halogen lamps, the burner contains a mixture of gases such as argon, mercury and metal halogens. The argon gas, through its ionization, enables the arc to be ignited when current is transported between the electrodes. Unlike so-called HPS (high pressure sodium) lamps, a metal halogen lamp works under high vapor pressure. In contrast to the HPS lamp, the metal halogen lamp has a higher light value of 75-90 Ra, preferably 80-85 Ra, with a color temperature in this example of 3000-6000° K, preferably 4000-5000° K. A so-called HPS lamp is shown in EP 0477914, in which a metal halogen lamp comprising a plurality of burners connected in parallel and side by side is also shown.

Document WO 91/09415 shows that double burners can be used for metal halogen lamps. Two parallel burners are arranged in a glass bulb.

U.S. Pat. No. 6,111,359 shows two burners connected in parallel, for increasing the working life of a halogen lamp.

WO 2009/006828 shows a metal halogen lamp having two burners placed side by side.

SUMMARY OF INVENTION

One way of solving the problem of how to increase the working life of a metal halogen lamp is thus, according to the invention, to arrange double burners in the lamp.

One of the burners is used each time the lamp is alight. After the lamp has been switched off, the burner which has the lowest pressure (due to this burner not having been alight and thus being colder) will light more easily when the lamp is switched on again. When a cold lamp which has not been used for a long time is switched on, one of the burners will be lit randomly. In this way, the metal halogen lamp will gain an increased working life realized by the alternating ignition of the parallel-mounted burners in the lamp.

With a knowledge of known metal halogen lamps with double burners, the problem remains of providing a metal halogen lamp with long working life which gives an optimal emission of light, at the same time as the metal halogen lamp can be produced as compactly as possible.

One way of solving the problem of improving the emission of light from the alternately working and parallelly arranged burners would be to increase the supply of energy to the burners. This is not cost-effective, however.

There is therefore a need to be able to provide a metal halogen lamp which has a long operating time, at the same time as being as compact as possible, and which can deliver an optimal emission of light during operation.

A further object of the invention is to eliminate drawbacks of the prior art.

DISCLOSURE OF INVENTION

The abovementioned objects have been achieved by means of the metal halogen lamp defined in the introduction and having the characteristics defined in the characterizing part of patent claim 1.

In this way, a metal halogen lamp which is space-saving and which at the same time can have long burning time and satisfactory light emission during use has been provided. The arc tube member which is switched off will hence not obscure with its glass the arc tube member which is currently lit.

One of the burners (the arc tube members) is used each time the lamp is alight. After the lamp has been switched off, the burner which has the lowest pressure will light more easily. Lighting of one of the burners occurs randomly when the lamp is cold. In this way, the metal halogen lamp will gain an increased working life realized by the alternate lighting of the two burners. The fact that the burners are laterally displaced relative to each other in tandem enables space to be saved without any effect on the light emission.

Preferably, the respective arc tube members are of elongated configuration, each with an imaginary center line defined in the longitudinal direction, which center lines extend substantially parallel with each other and at an angle of about 40-50° to the center line of the casing.

In this way, the outer casing, by virtue of the arc tube members inclined in the outer casing, can be produced as compactly as possible, at the same time as maximum light emission can be realized.

Alternatively, the conductive member comprises a first conductive rod coupled to the respective first end of the first arc tube and of the second arc tube member, and a second conductive rod coupled to the respective second end of the first arc tube and of the second arc tube. The first end of the respective arc tube is closer to the top part than the second end of the respective arc tube. The first and the second conductive rod extend parallel with the center line of the outer casing and are adjacent to the outer casing.

In this way, the conductive member has been realized with an uncomplicated structure, giving a cost-effective production of the metal halogen lamp, since the respective first and second conductive rod can be bent identically in the exit from the base part, which aids the production of the two conductive rods. At the same time, this structure of the conductive rods aids an inclined fitting of the arc tube members, which in turn gives a compact metal halogen lamp and maximum light emission.

Preferably, the free end of the first conductive rod, within the region of the coupling with the first end of the first arc tube member, is connected to a supporting device in contact with or adjacent to the top part of the outer casing.

In this way, an extra supporting device, which is additional to the rigid structure of a parallelogram (defined by the parallel arc tube members and parallel portions of the conductive rods between the coupling points for the respective arc tube members with the respective conductive rods) fixedly anchored in the base part, can serve to prevent the structure comprising arc tube members and conductive rods from causing damage to the outer casing should the metal halogen lamp be carelessly handled.

Expediently, the first conductive rod is about twice as long as the second conductive rod.

In this way, material can be saved in the production of conductive rods, which is cost-effective in the production of the metal halogen lamp.

Preferably, the extents of the first and second arc tube member and extents of the portions of the first and second conductive rod between their coupling points with the respective arc tube members form a parallelogram.

In this way, as a result of the fixed securement of the conductive rods in the base part, a rigid structure of arc tube members and conductive rods has been realized, which structure enables the metal halogen lamp simultaneously to be made compact and to generate light without the arc tube members obscuring each other during the alternate operation of the arc tube members.

Alternatively, a first electrode at the second end of the first arc tube member and a second electrode at the first end of the second arc tube member are also located in said plane.

In this way, an arc which is generated between the electrodes of an arc tube member during operation of the lamp is not obscured by nearby switched-off arc tubes.

Preferably, the conductive member comprises a conductive rod arranged with an insulating sleeve and coupled to the respective first end.

The loss of ions which otherwise tend to diffuse out through the glass of the arc tube member is thereby reduced. This reduction is realized by the insulating sleeve, which insulates the conductive member, made of metal, for example, so that the conductive member is exposed to the glass of the arc tube member to the least possible extent. This reduction in ion absorption will also reduce the blackening of the glass of the arc tube member and the inner side of the glass casing, which results in a further minor fall in light emission. Since the metal halogen lamp alternatively also comprises an insulating sleeve, it is likewise important to save space in the outer casing in terms of the placement of the burners.

Alternatively, the principal extent of the arc tube members coincides with the principal extent of the outer casing.

In this way, a casing of the metal halogen lamp can be realized as compact as possible by virtue of the casing being adaptable to the shape of the glass of the arc tube members. If the casing has a long and narrow shape and the arc tube members with their extent are arranged in the casing in tandem one behind the other, but with mutual displacement, viewed in relation to the center line, defined as a central line extending through the casing in the direction along the principal extent of the long and narrow shape, of a magnitude such that the conductive member coupled to the second end of the first arc tube member and the conductive member coupled to the first end of the second arc tube member can extend freely from the respective first and second end without the routing of the conductive member needing to be adapted to adjoining arc tube members.

Preferably, the first and second ends of the arc tube member are respectively constituted by a concentrically tapered tip.

The arc tubes can thus be arranged with their ends mutually overlapping, without an arc, during operation, needing to be obscured by adjoining arc tube members.

Alternatively, the number of arc tube members in the outer casing is three.

In this way, the working life can be further prolonged and a compact lamp can be realized. In order not to obscure one another, the arc tube members are arranged in line one behind the other with the respective end, lying opposite one another, in a common plane extending transversely to the center line of the casing.

The glass of the arc tube member preferably has a wall thickness which is thicker at the ends than in its middle portion.

In this way, the operating time has been further increased and the lamp does not need to be replaced as often, which is environmentally friendly since the thicker wall of the glass within the region of the electrodes, to a greater extent than in the prior art, prevents free metal atoms from being able to migrate through the wall of the glass during operation of the lamp. The middle portion can at the same time be produced thinner than the ends, which gives a cost-effective production since the material costs for arc tubes are generally high. At the same time, the arc tube member can thus also be realized with lower weight. Because of the thicker wall, any metal atoms which are not bonded to halogens during the operation of the lamp find it more difficult to diffuse out from the glass wall of the arc tube member. Since the molecules consisting of metal atoms and halogens are broken up to a greater degree in the vicinity of the electrode ends due to the higher temperature produced there and the vapor pressure, separate metal atoms, which do not form stable molecules with the halogens, are found to a greater degree at the end of the electrode.

Alternatively, the arc tube member also contains zinc and zinc sulphide for the amplification of light generated by the arc.

Any shielding of light in the direction along the center line, due to the second arc tube member arranged above or below, is thus compensated. Pure zinc has a very satisfactory refractive index, which increases the light intensity in the arc tube. Zinc sulphide exhibits phosphorescence, due to impurities, upon illumination with blue or ultraviolet light. The arc tube thus comprises, apart from said zinc and zinc sulphide, a mixture of gases such as argon, mercury and metal halogens. The argon gas, as a result of its ionization, enables ignition of the arc when current is transported between the electrodes. The heat which is formed by the are will then vaporize the mercury and the metal halogens. These vaporized metals produce light when the pressure is raised and the temperature rises in the burner.

Preferably, the wall of the arc tube member comprises ceramic glass. The wall, or the glass body of the arc tube, is advantageously made solely of ceramic glass.

The are tube member is thereby heat-resistant, transparent and has a high melting point. Ceramic glass has the advantage of being electrically insulating and is chemically stable. Ceramic glass, such as neoceramic glass, tolerates very high heat.

Alternatively, the wall of the arc tube member comprises quartz glass. The wall or the glass body of the arc tube is advantageously made exclusively of quartz glass.

A cost-effective production is thereby obtained, as quartz glass has a relatively low production cost.

BRIEF DESCRIPTION OF DRAWINGS

The invention will now be explained with reference to the drawing, in which, in schematic representation.

MODE(S) FOR CARRYING OUT THE INVENTION

Figure 6A:
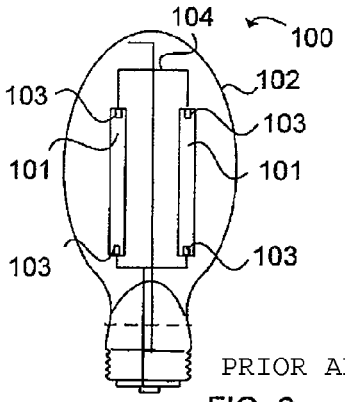
PRIOR ART FIG. 6a
FIG. 6*a* shows a structure of an HPS lamp according to the prior art.

The invention will be described in close detail with the aid of embodiments. For the sake of clarity, components without importance to an explanation of the invention have been omitted in the drawing. The embodiments should not be regarded as limiting the invention, but are only examples.

Figure 1:
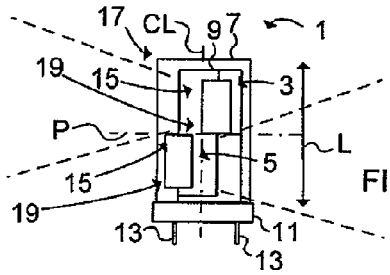
FIG. 1 shows a metal halogen lamp according to a first embodiment of the invention.

FIG. 1 shows in schematic representation a metal halogen lamp 1 according to a first embodiment. A first 3 and a second 5 burner are arranged in an outer casing 7 and are electrically connected in parallel. They are coupled via the conductive member 9 to an electric circuit (not shown) accommodated in a base part 11. The base part 11 comprises two pins 13 for connection to a current source (not shown). The base part 11 is thus connected to the first 3 and the second burner 5. Each burner 3, 5 has a first end 15, which is facing toward the top part 17 of the outer casing 7. The top part 17 is arranged opposite the base part 11. Each burner 3, 5 also comprises a second end 19, which is facing toward the base part 11. The first burner 3 is arranged closer to the top part 17 than the second burner 5. The extent of the burners 3, 5 coincides parallelly with the extent of the outer casing 7. That is to say, the center lines of the burners 3, 5 have the same direction as the center line CL of the outer casing 7. The second end 19 of the first burner 3 and the first end 15 of the second burner 5 adjoin an imaginary plane P defined substantially transversely to the center line CL of the outer casing 7, which center line extends from the top part 17 to the base part 11. Since the first burner 3 is arranged displaced along the center line CL relative to the second burner 5, the burner which is switched off during operation of the metal halogen lamp 1 will not obscure the burner which is lit. In other words, an arc which is generated between electrodes (not shown) of the burner which is lit will not be obscured by the switched-off burner. The electrodes (not shown) are arranged at the respective end 15, 19. Since the burners 3, 5 are displaced also in the direction transversely to the center line CL, a wiring of the electrically parallel-connected burners 3, 5 can be realized in compact form at the ends 15, 19 of the two burners 3, 5, which ends are situated very close together. The length L of the outer casing 7 can thereby be made as short as possible without any effect on the emission of light.

Figure 2:
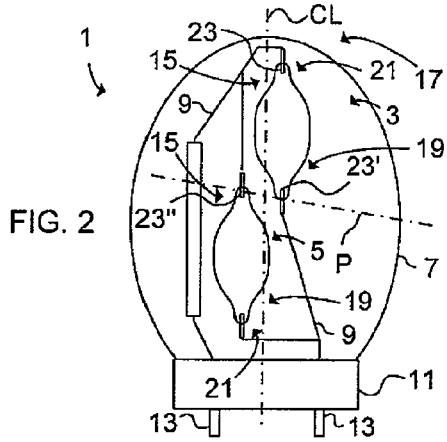
FIG. 2 shows a metal halogen lamp according to a second embodiment of the invention.

FIG. 2 shows in schematic representation a metal halogen lamp 1 according to a second embodiment of the invention. The first 15 and second 19 end of the burner 3, 5 are here constituted by a concentrically tapered tip 21. Each concentrically tapered tip 21 comprises an electrode 23. A first electrode 23' at the second end 19 of the first burner 3 and a second electrode 23" at the first end 15 of the second burner 5 are located in the imaginary plane P. The imaginary plane P extends substantially transversely to the center line CL of the casing. The length of each burner 3, 5 is twice as large as the width (diameter) of the burners 3, 5.

Figure 3:
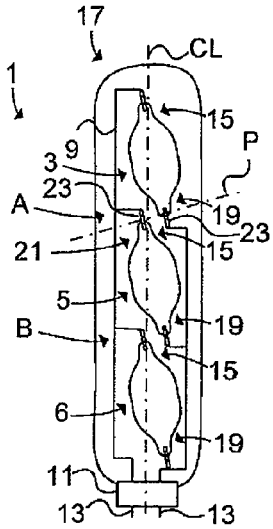
FIG. 3 shows a metal halogen lamp according to a third embodiment of the invention.

FIG. 3 shows in schematic representation a metal halogen lamp 1 according to a third embodiment of the invention. According to this illustrative embodiment, the number of burners in the casing is three 3, 5, 6. The burners 3, 5, 6 are somewhat inclined in relation to the center line CL and are in line one behind the other, but with their electrodes 23 (at the adjoining ends at two points A and B in the metal halogen lamp) to some extent mutually overlapping by virtue of the concentrically tapered tip 21 of the respective end 15, 19. The ends 15, 19 lie in the imaginary plane P, extending transversely to the center line CL of the outer casing 7.

Figure 4:
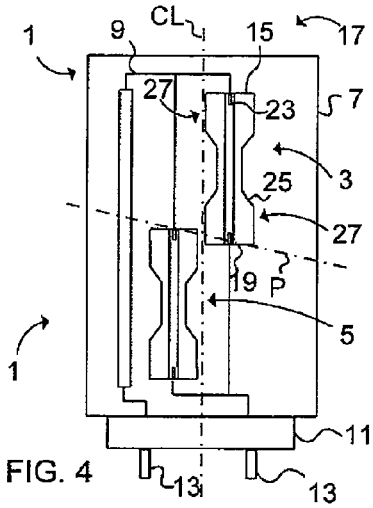
FIG. 4 shows a metal halogen lamp according to a fourth embodiment of the invention.

FIG. 4 shows in schematic representation a metal halogen lamp 1 with a power of 50-70 W according to a fourth embodiment of the invention. The glass of the burners 3, 5 has a wall thickness which is thicker at the ends 15, 19 than in its middle portion. During operation of the metal halogen lamp 1, an arc (not shown) is generated between the electrodes 23. The arc is generated by means of a gas mixture consisting of mercury and argon and other substances which give the metal halogen lamp 1 its characteristics. A driver (not shown) is arranged in the base part 11 in order to be able to switch on the respective burner 3, 5. The driver regulates the current through the burner which is alight following the creation of a voltage pulse which starts the arc. Each burner 3, 5 also contains zinc and zinc sulphide for the amplification of light generated by the arc, and the wall of the burner comprises ceramic glass. The metal halogen lamp 1 has a light value of 75-90 Ra, preferably 80-85 Ra, with a color temperature in this example of 3000-6000° K, preferably 4000-5000° K. The other substances in the gas mixture enclosed in glass body are, above all, halogens and metal atoms. The argon gas, which can be easily ionized, enables the formation of the electric arc when a current is generated across the electrodes 23. The heat which is then produced by the electric arc in turn engenders the vaporization of mercury and metal halogens and light is generated as the pressure and temperature in the burner increase.

Each burner 3, 5 in FIG. 4 is made up of a hollow glass body 25 and respectively comprises two ends and a middle portion. The ends (surfaces extending transversely to the direction of the center line CL) and a circumference of the glass of the burner within the region of an end portion 27 of the burner 3 have a thicker glass wall in order to achieve longer working life of the burner 3. This is made possible by the fact that free metal atoms in the burner 3, 5, during operation, find it more difficult to diffuse out of the burner 3, 5 by virtue of the thicker glass. In this way, a longer working life of the metal halogen lamp 1 can be further realized.

Figure 5A:
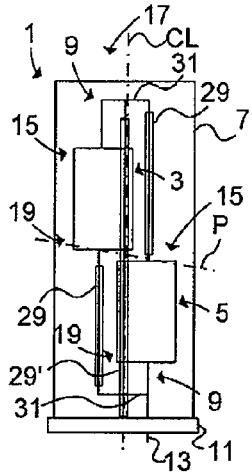
FIGS. 5*a*-*b* show a metal halogen lamp according to a fifth embodiment of the invention.
Figure 5B:
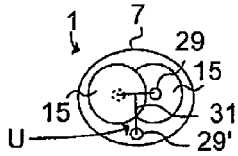

FIGS. 5*a*-5*b* show in schematic representation a metal halogen lamp 1 according to a fifth embodiment of the invention. The conductive member 9 comprises a metal conductive rod 31 arranged with an insulating sleeve 29 and coupled to the respective first end 15 from the electric circuit (not shown) of the base part 11. A conductive rod 31 from the second end 19 of the first burner 3 is also provided with an insulating ceramic sleeve 29. The insulating sleeve 29 ensures the reduction of blackening of the burner 3, 5, in which case the light emission can be optimized. In FIG. 5*b*, the metal halogen lamp 1 is shown from above, wherein it is portrayed that the insulating sleeve 29', which is arranged around the conductive rod 31 between the first ends 15 and the base part 11, is expediently placed parallel with the burners 3, 5 and in a space U formed by the overlapping of the burners 3, 5 viewed in the direction along the center line CL.

FIG. 6*a* shows a structure of an HPS lamp 100 according to the prior art. The HPS lamp comprises two elongated arc tubes (burners) 101, which are enclosed in an evacuated glass casing 102. The electrodes 103 of the arc tube 101 are connected to the lamp base via conductors 104, which are disposed inside the glass casing. The burners 101 of the known HPS lamp 100 are arranged side by side due to their elongated configurations. HPS lamps 100 are generally very sensitive to deviations in the supplied principal voltage and elongated configurations of the burners are preferred. The length of the burners is seven times larger than the width of the burners.

Figure 6B:
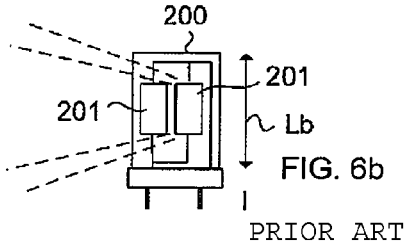
FIG. 6b PRIOR ART
FIGS. 6*b*-6*c* show a basic structure of a metal halogen lamp with double arc tube members according to the prior art.

FIG. 6*b* shows a basic structure of a metal halogen lamp 200 with double arc tube members 201 according to the prior art, in which the burners, in the same way as the burners in FIG. 6*a*, are arranged parallel with each other. The length/width ratio is, by contrast, 2:1 and the burners 201 in the metal halogen lamp 200 are thus significantly shorter than in an HPS lamp. During operation of the metal halogen lamp 200 in FIG. 6*b*, when the first burner is alight the light from the first burner will be partially shaded by the second burner, which is illustrated with dashed lines. The metal halogen lamp 200 in FIG. 6*b* can be made short and the length Lb is dependent on the length of the burner 201, whereby the metal halogen lamp 200 can be made compact, though with impaired light emission.

Figure 6C:
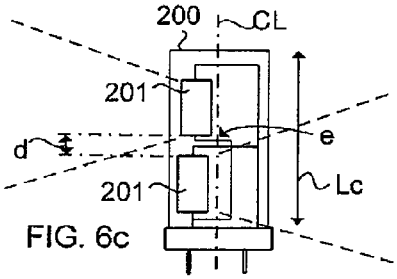
FIG. 6c PRIOR ART

FIG. 6*c* shows a basic structure of a metal halogen lamp 200 with double arc members 201, likewise according to the prior art. The arc members (the burners) 201 are arranged in a straight line one behind the other. Since the burners are electrically connected in parallel, the second end of the first burner has to be coupled to a first pole and the first end of the second burner has to be coupled to a second pole. This means that the distance d between the first and second end has to be realized to make space for a wiring e transversely to the center line CL of the casing, which in turn implies a bulky metal halogen lamp in the longitudinal direction with the length Lc.

Figure 7A:
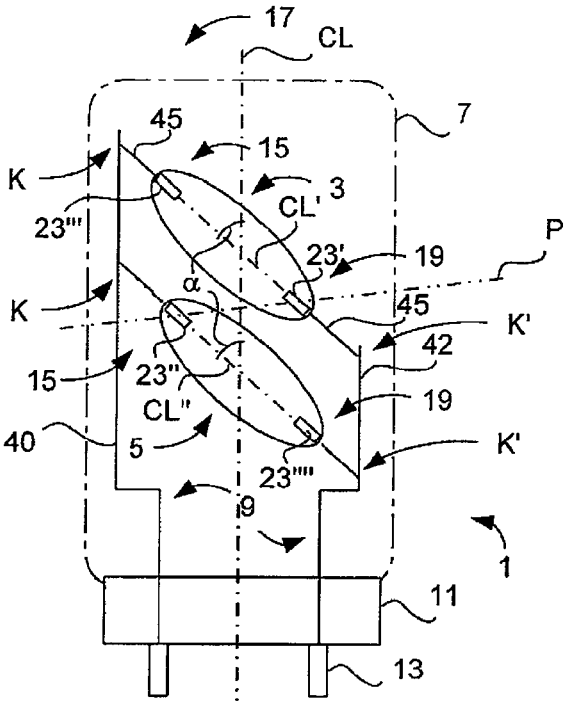
FIG. 7*a* shows a preferred embodiment of the invention, wherein the respective longitudinal extent of the arc tube members is inclined relative to the longitudinal extent of the outer casing.

FIG. 7*a* shows a preferred embodiment of the invention, wherein the respective longitudinal extent of the arc tube members 3, 5 is inclined relative to the longitudinal extent of the outer casing 7. The respective arc tube member 3, 5 is of elongated configuration. Each arc tube member 3, 5 has an imaginary center line CL', CL" defined in its longitudinal direction. The two center lines CL', CL" extend substantially parallel with each other and at an angle α to the center line CL of the outer casing 7 of about 40-50°, preferably 43-47°. By virtue of the arc tube members 3, 5 inclined in the outer casing 7, the outer casing 7 can thereby be produced as compactly as possible, while, at the same time, maximum light emission can be achieved. The first arc tube member 3 comprises a first electrode 23' situated within the region of the second end 19 of the first arc tube member 3. The second arc tube member 5 comprises a second electrode 23" situated within the region of the first end 15 of the second arc tube member 5.

The conductive member 9 comprises a first conductive rod 40, which is coupled firstly to the first end 15 of the first arc tube 3 and secondly to the first end 15 of the second arc tube member 5. The first conductive rod 40 extends parallel with the center line CL of the outer casing 7 and in a straight line from the edge region of the base part 11 to the edge region of the top part 17, wherein contact points K lie in line one above the other viewed in the direction parallel with the center line CL of the outer casing 7. The conductive member 9 also comprises a second conductive rod 42, which is coupled firstly to the second end 19 of the first arc tube 3 and secondly to the second end 19 of the second arc tube 5. The second conductive rod 42, too, extends in a straight line parallel with the first conductive rod 40, but is half as long as the first conductive rod 40. The coupling points K' are in line one above the other viewed in the direction parallel with the center line CL of an outer casing 7. The relatively steep inclination of the arc tube members means that the respective conductive rod 40, 42 for a metal halogen lamp 1 can be made of as little conductive rod material as possible, at the same time as the metal halogen lamp 1 can be made as compact as possible, while the two arc tube members 3, 5 do not "shade" each other, wherein the metal halogen lamp 1 can deliver as high a light emission as possible. The first end 15 of the respective arc tube 3, 5 is situated closer to the top part 17 than the second end 19 of the respective arc tube 3, 5. The first 40 and the second 42 conductive rod extend parallel with the center line CL of the outer casing and are adjacent to the inner side of the outer casing 7. Each of the electrodes 23', 23", 23'", 23"" is connected to a respective conductive rod 40, 42 via a conducting portion 45.

The arc tube members 3, 5 are thus inclined in relation to the center line CL of the outer casing 7. The arc tube members 3, 5 mutually overlap and are displaced relative to each other. The electrode 23' within the region of the second end 19 of the first arc tube 3 lies in the plane P. The electrode 23" within the region of the first end 15 of the second arc tube member 5 likewise lies in the plane P. The plane P has its extent substantially transversely to the center line CL of the outer casing 7. The center line CL of the outer casing 7 extends in the longitudinal direction of the outer casing 7 and is situated centrally therein.

The conductive member 9 has thereby been realized with an uncomplicated structure, which gives a cost-effective production of the metal halogen lamp 1, and the respective first 40 and second 42 conductive rod can be bent identically at the exit from the base part 11, which aids the production of the conductive member 9 having the first and second conductive rod 40, 42. At the same time, this structure of the first and second conductive rod 40, 42 aids an inclined fitting of the arc tube members 3, 5, which per se gives a compact metal halogen lamp 1 combined with maximum light emission, as discussed above.

Figure 7B:
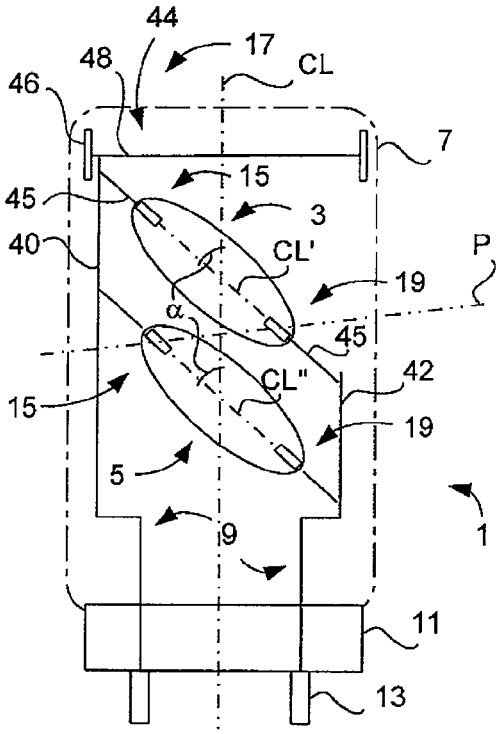
FIG. 7*b* shows a further embodiment of the metal halogen lamp in FIG. 7*a*, wherein the structure comprising conductive rods and arc tube members has been supplemented by a supporting device for protecting the outer casing from damage by said structure.

FIG. 7*b* shows a further embodiment of the metal halogen lamp 1 in FIG. 7*a*, wherein the structure comprising conductive rods 40, 42 and arc tube members 3, 5 has been supplemented by a supporting device 44 for protecting the outer casing 7 from damage by the arc tube members 3, 5 suspended in the conductive rods 40, 42 (or vice versa) in the event of possible impact upon the metal halogen lamp 1. The supporting device 44 comprises a transverse rod 48, which extends transversely to the center line CL and to the ends of which are fastened two support plates 46 arranged at 1 mm distance from the inner side of the outer casing 7.

The free end of the first conductive rod 40, within the region of the coupling with the first end 15 of the first arc tube member 3, is connected to the supporting device 44 adjoining to the inner side of the outer casing 7 in the top part 17. A structure according to a parallelogram (which is defined by the parallel and mutually displaced arc tube members 3, 5 and by parallel portions of the conductive rods, legs c, d in FIG. 8*a*—which portions are each defined as a portion of the conductive rod situated between the coupling points K connecting the respective arc tube member to the conductive rod) has been realized, which structure is fixedly anchored in the base part 11. The supporting device 44 serves to supplement the rigid structure of the conductive rod 9 according to a parallelogram.

Figure 8A:
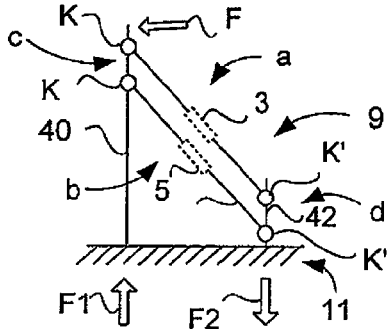
FIGS. 8*a*-8*c* show the principle for a rigid structure comprising conductive rods and arc tube members according to a parallelogram.
Figure 8B:
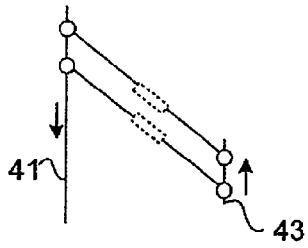
Figure 8C:
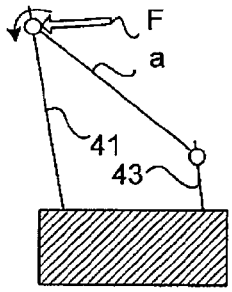

FIG. 8*a* shows in schematic representation the principle for a rigid structure according to said parallelogram, which rigid structure comprises the first 40 and second 42 conductive rod and, shown schematically on these, arc tube members 3, 5. Because the first and the second conductive rod 40, 42 are fixedly anchored in the base part 11, a rigid structure of the conductive member 9 is achieved. When the force F is applied to the conductive member 9, forces F1 and F2 of the securement to the base part 11 counteract, so that the parallelogram does not "collapse", at the same time as the four legs a, b, c, d of the parallelogram make the conductive member 9 rigid. In FIG. 8*b*, it is shown theoretically how the parallelogram changes shape should a first and a second conductive rod 41, 43 not be fixedly anchored in the base part 11. The principle for the advantages of the structure of the conductive member is also shown pedagogically in FIG. 8*c*. FIG. 8*c* shows an example of another structure with rods, in which only one arc tube forms the leg a (the leg b does not exist and no parallelogram is realized). Despite the fastened securement of the conductive rods 41, 43, the construction will be rotated if the force F is applied.

Figure 9A:
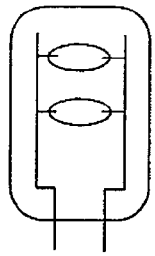
Fig. 9a PRIOR ART
FIG. 9*a* shows the prior art for comparison with the invention.

FIG. 9*a* shows the prior art for comparison with the invention. The prior art in FIG. 9*a* shows two arc tubes arranged side by side in parallel and inclined in the outer casing with their longitudinal axes at 90 degrees to the center line of the outer casing. A metal halogen lamp having such a structure is bulky in width and requires an unnecessary amount of conductive rod material in order to support the two arc tube members.

The invention should not be regarded as limited by the above-described embodiments, but rather within the scope of the invention there are also other embodiments which likewise describe the inventive concept, or combinations of the described embodiments. For example, other gas mixtures can be used than those which have been described. The arc tube members can be produced in other materials than ceramic glass or quartz glass. The ends can have a gradually decreasing thickness and can be constituted by flat end faces or conical ends. The base part can be arranged with pins or can be configured as a screw base. The supporting device can comprise transverse rods, which extend transversely to the center line CL and to the ends of which are fixed two support plates bearing against the inner side of the outer casing.

The invention claimed is:

1. A metal halogen lamp comprising:

an outer casing, a base part, and inside the outer casing, first and second arc tube members, which are electrically parallel-connected and are connected via conductive members to the base part, each arc tube member having a first end, facing toward a top part of the outer casing opposite the base part, and a second end, facing toward the base part, the first arc tube member is arranged closer to the top part than the second arc tube member, and the second end of the first arc tube member and the first end of the second arc tube member adjoin an imaginary plane (P) defined substantially transversely to the center line (CL) of the outer casing, which center line extends from the top part to the base part, wherein the respective arc tube members are of elongated configuration, each with a defined imaginary center line (CL', CL"), wherein the conductive member comprises a first conductive rod coupled to the respective first end and a second conductive rod coupled to the respective second end, and the two conductive rods extend parallel with the center line (CL) of the outer casing and are adjacent to the outer casing, and wherein the center lines (CL', CL") extend substantially parallel with each other and at an angle ($\alpha$) of 40-50° to the center line (CL) of the outer casing, and the extents of the first and second arc tube member and extents of the portions of the first and second conductive rod between their coupling points with the respective arc tube members form a parallelogram.

2. The metal halogen lamp as claimed in claim 1, wherein the free end of the first conductive rod, within the region of the coupling with the first end of the first arc tube member, is connected to a supporting device in contact with or adjacent to the top part of the outer casing.

3. The metal halogen lamp as claimed in claim 1, wherein the first conductive rod is about twice as long as the second conductive rod.

4. The metal halogen lamp as claimed in claim 1, wherein a first electrode at the second end of the first arc tube member and a second electrode at the first end of the second arc tube member are also located in said plane (P).

5. The metal halogen lamp as claimed in claim 1, wherein the conductive member comprises a conductive rod arranged with an insulating sleeve and coupled to the respective first end.

6. The metal halogen lamp as claimed in claim 1, wherein the first and second end of the arc tube member are respectively constituted by a concentrically tapered tip.

7. The metal halogen lamp as claimed in claim 1, wherein the number of arc tube members in the outer casing is three.

8. The metal halogen lamp as claimed in claim 1, wherein a wall of the arc tube member has a wall thickness which is thicker at the ends than in its middle portion.

9. The metal halogen lamp as claimed in claim 1, wherein the arc tube member also contains zinc and zinc sulphide for the amplification of light generated by the arc.

10. The metal halogen lamp as claimed in claim 1, wherein a wall of the arc tube member comprises ceramic glass.

11. The metal halogen lamp as claimed in claim 1, wherein a wall of the arc tube member comprises quartz glass.

12. The metal halogen lamp as claimed in claim 1, wherein the angle ($\alpha$) is further limited to 43-47° relative to the center line (CL) of the outer casing.

* * * * *